US007604606B2

(12) United States Patent
Dehli

(10) Patent No.: US 7,604,606 B2
(45) Date of Patent: Oct. 20, 2009

(54) INTENSITY CONTROL FOR MASSAGE DEVICES

(75) Inventor: Hans Dehli, Dana Point, CA (US)

(73) Assignee: Human Touch, LLC, Long Beach, CA (US)

( * ) Notice: Subject to any disclaimer, the term of this patent is extended or adjusted under 35 U.S.C. 154(b) by 0 days.

(21) Appl. No.: 10/841,073

(22) Filed: May 6, 2004

(65) Prior Publication Data

US 2005/0004497 A1 Jan. 6, 2005

Related U.S. Application Data

(60) Provisional application No. 60/468,348, filed on May 6, 2003.

(51) Int. Cl.
*A61H 1/00* (2006.01)

(52) U.S. Cl. ..... 601/46; 601/49; 602/13; 128/DIG. 13

(58) Field of Classification Search ..... 601/23–24, 601/46–50, 149; 297/284.6, 284.1, 452.41; 602/5, 13; 128/DIG. 20
See application file for complete search history.

(56) References Cited

U.S. PATENT DOCUMENTS

| | | | | |
|---|---|---|---|---|
| 3,974,827 | A | 8/1976 | Bodeen | |
| 4,890,885 | A | 1/1990 | Grossmann | |
| 4,981,131 | A * | 1/1991 | Hazard | 601/24 |
| 5,320,409 | A | 6/1994 | Katoh et al. | |
| 5,343,878 | A * | 9/1994 | Scarberry et al. | 128/898 |
| 5,348,530 | A * | 9/1994 | Grim et al. | 602/13 |
| 6,367,106 | B1 | 4/2002 | Gronsman | |
| 6,592,184 | B1 | 7/2003 | Segal et al. | |
| 6,671,911 | B1 | 1/2004 | Hill et al. | |
| 2006/0009717 | A1 * | 1/2006 | Hall et al. | 601/41 |

FOREIGN PATENT DOCUMENTS

| | | | |
|---|---|---|---|
| DE | 36 33 092 | C1 | 1/1988 |
| DE | 43 24 508 | A1 | 1/1995 |
| WO | WO 01/89348 | A2 | 11/2001 |

OTHER PUBLICATIONS

European Search Report for corresponding European Application No. 04760742.9, mailed Mar. 25, 2009, 3pp.

* cited by examiner

*Primary Examiner*—Michael A. Brown
(74) *Attorney, Agent, or Firm*—Christie, Parker & Hale, LLP.

(57) ABSTRACT

An air-tight foam-filled bladder is used for varying massage intensity in a massage chair, massage mat, or other massage device. The bladder may be compressed from a default or relaxed thickness by evacuating air from the bladder. The thickness of the foam-filled bladder may be reduced to a collapsed thickness in which the foam is compressed within the bladder. In use, the foam-filled bladder is placed proximate a conventional fixed massage mechanism in a massage device, such as in the back rest of a massage chair. By controlling the amount of air evacuated from the bladder, the intensity of the massage is controlled by varying the amount of pressure exerted by the fixed massage mechanism on the user. In the case of a massage chair, the user may advantageously sit back in the chair without discomfort when the user does not want a massage, and may control the intensity of the massage provided by the chair. In another embodiment, an active pump may be used to inflate one or more bladders that may or may not include a foam insert. The number, size and location of the bladders may be varied in any of the embodiments.

33 Claims, 6 Drawing Sheets

10
12
14
16
18
20
22
24
26
28
30
32
34
$W_R$
$W_C$

INTENSITY CONTROL FOR MASSAGE DEVICES

CROSS-REFERENCE TO RELATED APPLICATION

This application claims the benefit of U.S. Provisional Application No. 60/468,348, filed May 6, 2003, the disclosure of which is hereby incorporated by reference.

FIELD OF THE INVENTION

The present invention relates generally to massage devices such as massage chairs, massage mats, massage tables or other massage devices, and more particularly, to an apparatus and method for controlling massage intensity in such devices.

BACKGROUND

There currently exist a wide variety of massage devices, such as massage chairs, massage tables and massage mats, all of which aim to provide a relaxing massage to the person using the device. The massage is typically provided via a conventional massage mechanism that includes eccentric wheels or other apparatus that, when activated, have the effect of translating a compression, percussion, kneading or rolling motion onto the user's body. In the case of a massage chair, for example, the massage mechanism is typically mounted within the back rest of the chair such that the massaging motion is applied to the user's back when the mechanism is turned on.

One disadvantage of conventional massage mechanisms is that they often cause discomfort in the user's body when the mechanism is off, because the non-moving wheels or other massage components create undesirable fixed pressure points on the user's body. In the case of a massage chair, for example, this limits the desirability of sitting in the chair with the massage mechanism turned off.

In addition to potential discomfort with the massage mechanism off, the massage action is typically controllable by changing the speed and location of the massage as opposed to changing the amount of pressure exerted on the user. In the case of a massage chair, for example, the speed and movement of the massage wheel can be varied generally along a direction parallel to the surface of the back rest on which the user lays back, as opposed to inwardly and outwardly against the surface. Being able to move the massage mechanism inwardly and outwardly provides the benefit of varying the intensity of the massage and also helps to move the wheels inwardly away from the surface of the back rest when the massage mechanism is off, thereby minimizing undesirable pressure points on the user's back.

There currently exist massage mechanisms for chairs that are mechanically movable inwardly and outwardly against the backrest of the chair to provide the aforementioned benefits, but they typically require some sort of mechanical assembly that moves the entire massage mechanism with respect to the frame of the back rest. It would be desirable to enable control of massage intensity in conjunction with a mechanism that is fixedly attached to the massage device in a conventional manner, such as a massage mechanism attached to the frame of the back rest of a chair. This would eliminate the need for more complicated or costly devices in which the entire massage mechanism moves, while providing comparable benefits.

SUMMARY OF THE INVENTION

The present invention provides an air-tight foam-filled bladder for massage devices that may be compressed from a default or relaxed thickness by evacuating air from the bladder. The thickness of the foam-filled bladder may be reduced to a collapsed thickness in which the foam is compressed within the bladder. In use, the foam-filled bladder is placed proximate a conventional fixed massage mechanism in a massage device, such as in the back rest of a massage chair. By controlling the amount of air evacuated from the bladder, the intensity of the massage is controlled by varying the amount of pressure exerted by the fixed massage mechanism on the user. In the case of a massage chair, the user may advantageously sit back in the chair without discomfort when the user does not want a massage, and may control the intensity of the massage provided by the chair.

In an alternate embodiment, an active pump may be used to inflate one or more bladders that may or may not include a foam insert. The number, size and location of the bladders may be varied in any of the embodiments.

BRIEF DESCRIPTION OF THE DRAWINGS

These and other features of the present invention will be better understood with reference to the following detailed description read in conjunction with the following drawings, wherein.

DETAILED DESCRIPTION

Figures 1, 2, 3:
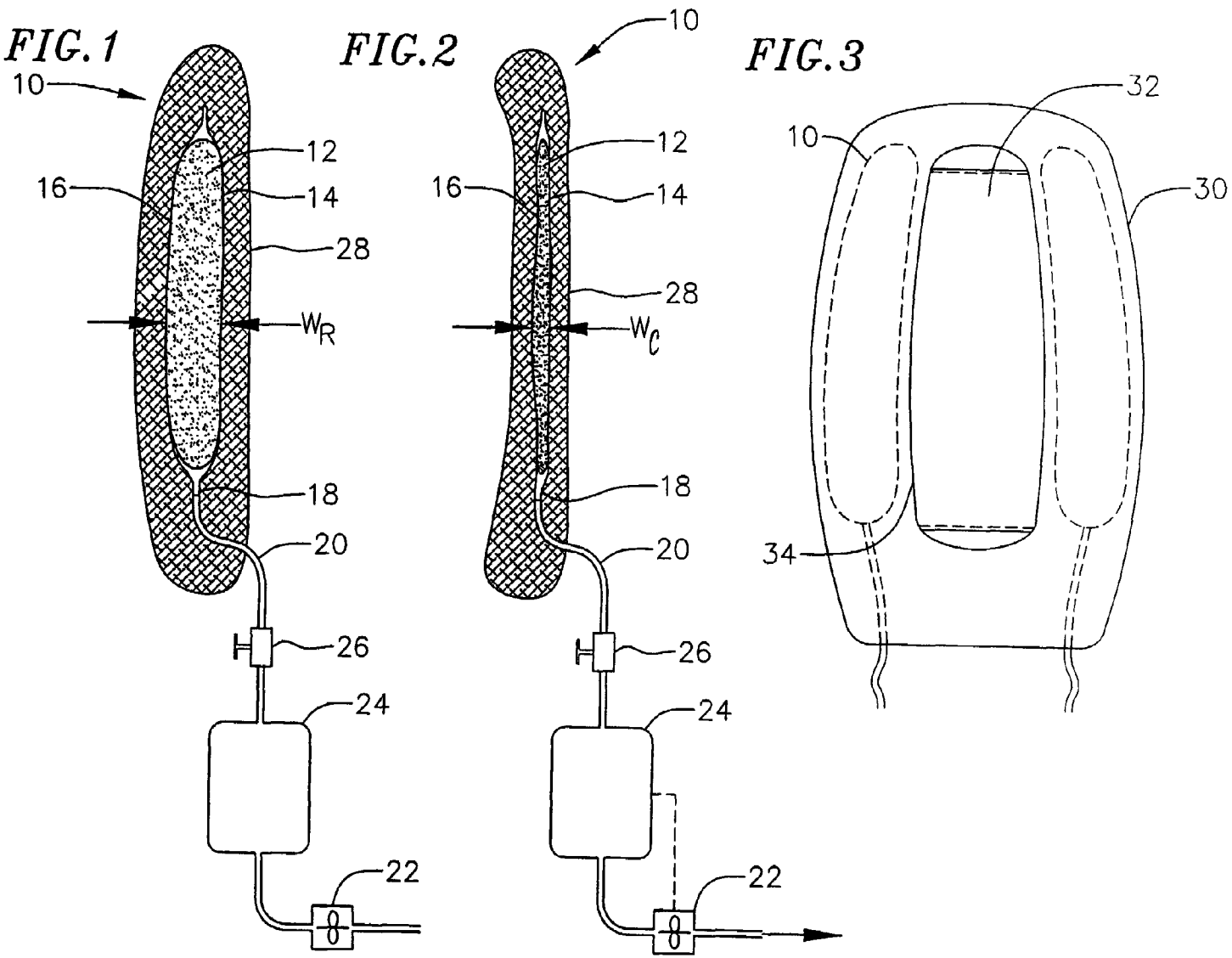
FIG. 1 is a side view, partly in cross-section, of an exemplary foam-filled bladder, in a relaxed position, for controlling massage intensity.
FIG. 2 is a side view, partly in cross-section, of the apparatus of FIG. 1 in a collapsed position.
FIG. 3 is a front cross-sectional view of the back rest of an exemplary massage chair fitted with a pair of foam-filled bladders for controlling massage intensity.

Referring to FIG. 1, an exemplary embodiment of the foam-filled bladder 10 according to the present invention includes an inflatable bladder 12 forming a hollow internal cavity 14 with foam 16 snugly fitted within the cavity. The bladder may be made of neoprene or other airtight material. The foam core may be conventional furniture foam, such as polyurethane or other suitable material. The bladder includes an inlet 18 and a channel or tube 20 for evacuating air from the bladder by any conventional method, such as via a vacuum pump 22 with a controllable valve 26. The foam-filled bladder may be placed in a conventional cushion 28 that may form a portion of the interior of the back rest of a conventional massage chair or other device. In the default position shown in FIG. 1, the foam retains its normal shape within the bladder, giving the bladder a default or relaxed thickness $w_R$. Referring to FIG. 2, evacuating air from the bladder collapses the bladder and compresses the foam within the cavity, thereby narrowing the width or thickness of the foam-filled bladder to a collapsed thickness $w_C$.

Referring to FIG. 3, in one embodiment, two foam-filled bladders 10, formed as elongated members, are fitted within the massage device, such as the back rest 30 of a massage chair (not shown), proximate a conventional massage mechanism 32 fixedly mounted within the frame 34 of the backrest of the chair. In operation, the user of the massage chair turns on the massage mechanism using a conventional control. To adjust the intensity of the massage delivered by the massage mechanism, the user controls the amount of air in the bladder. In the relaxed position, the foam retains its normal shape within the bladder. In the exemplary embodiment, the bladder relaxed thickness $w_R$ (FIG. 1) removes or minimizes fixed pressure points exerted by the proximately-located massage mechanism when the mechanism is off. This allows the massage chair to be comfortably used as a regular chair by the user without the discomfort of the massage mechanism applying unwanted pressure against the user's body. As air is evacuated from the bladder, the thickness of the bladder decreases to the collapsed thickness $w_C$ (FIG. 1) thereby increasing the intensity of the massage felt by the user when the chair is being used as a massage device.

Referring to FIG. 4, the foam-filled bladder 10 may be constructed by cutting a piece of foam 16 in the desired shape and with the desired dimensions to set a default or relaxed position for a given massage device wherein the user will not feel the massage mechanism. The foam is laid over a first piece of bladder material 35, then a second piece of bladder material 36 is laid over the top of the foam and heat sealed 37 to a major portion the first piece to create an air-tight, hermetically sealed foam-filled bladder with an air inlet 18. One end of the channel or tube 20 is attached to the inlet and heat stitched in a manner that renders the bladder air-tight. The other end of the tube is then added to the vacuum pump or other conventional device with a controllable valve for evacuating air from the bladder. Any other suitable method for fabricating the foam-filled bladders may be employed.

Figures 4A, 4B, 5:
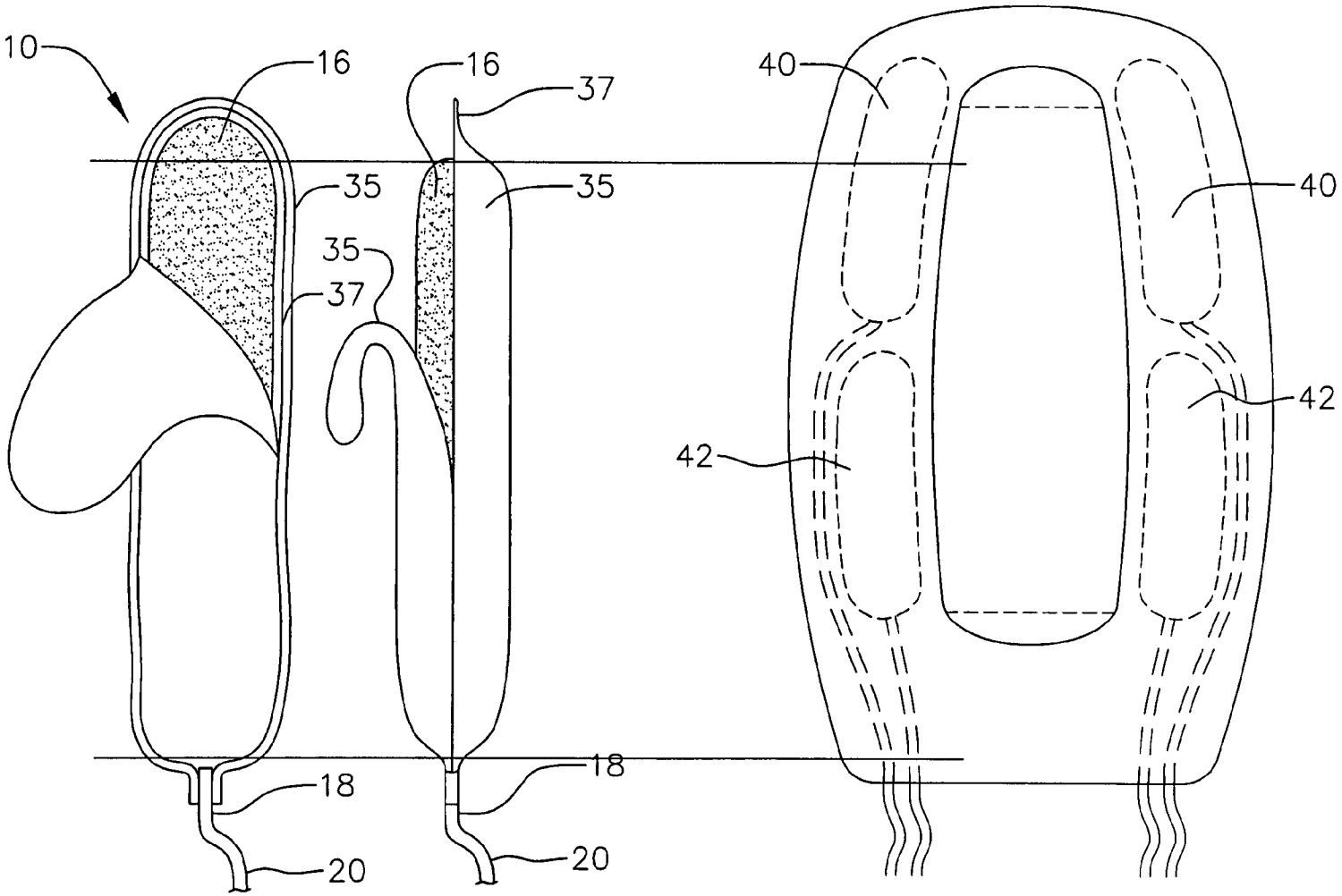
FIGS. 4A and 4B are front and side cutaway views, respectively, of the foam-filled bladder of FIG. 3.
FIG. 5 is a front cross-sectional view of an alternate embodiment of the present invention in which four foam-filled bladders are used in an exemplary massage chair.

Referring to FIG. 5, in an alternate embodiment, two upper foam filled bladders 40 and two lower foam filled bladders 42 are used on opposite sides of a massage mechanism fixedly mounted to the backrest 44 of a conventional massage chair. By using upper and lower pairs, additional degrees of lower and upper back massage intensity control are enabled. It will be appreciated that any number of bladders may be used and configured in different shapes and sizes to create the desired massage intensity effect in a given massage device. The bladders may be individually or collectively controlled, and may be incorporated as part of a conventional automatic massage sequence to vary massage intensity as part of an automatic massage.

Figure 6:
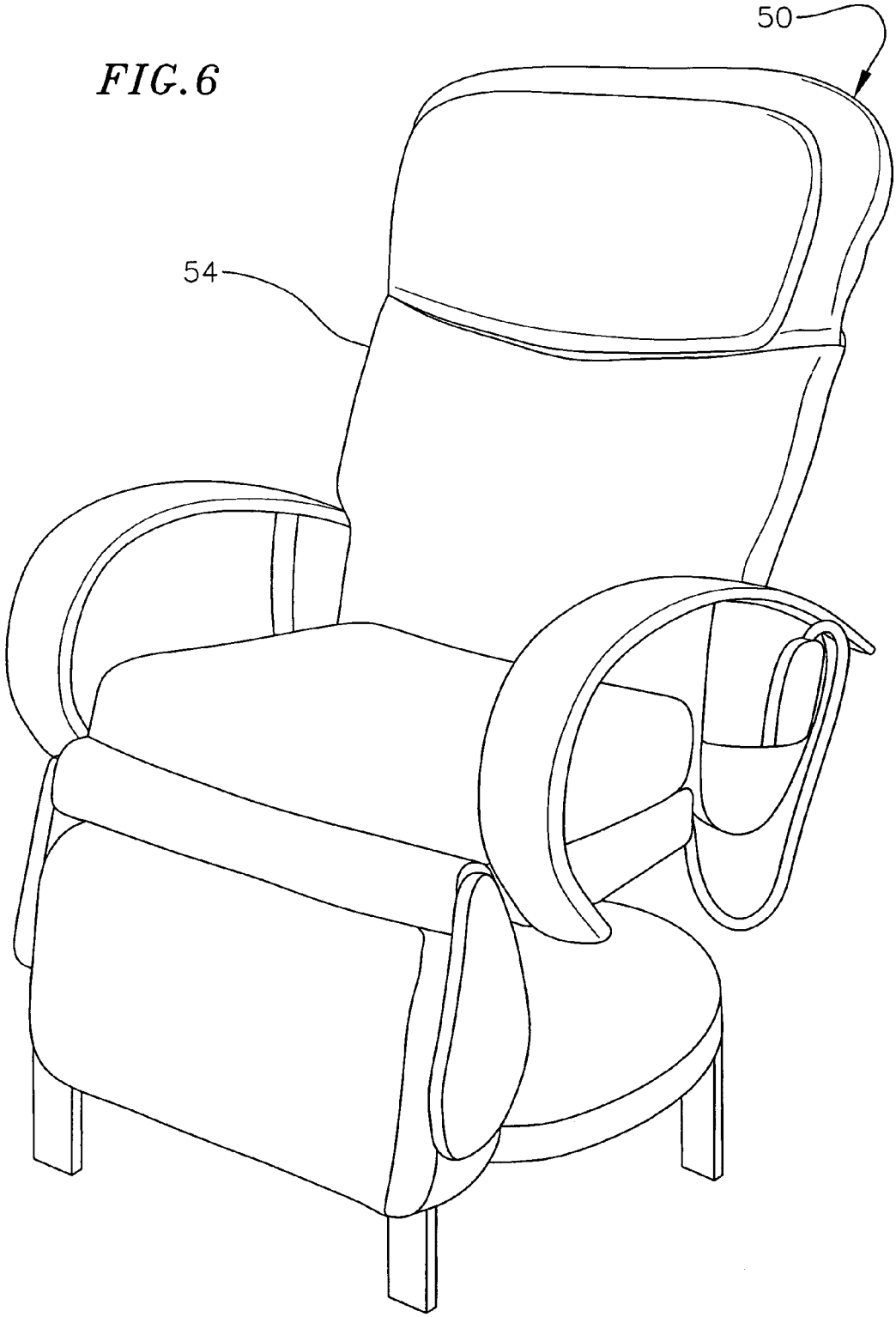
FIG. 6 is a perspective view of a conventional massage chair having a removable back rest portion.
Figure 7:
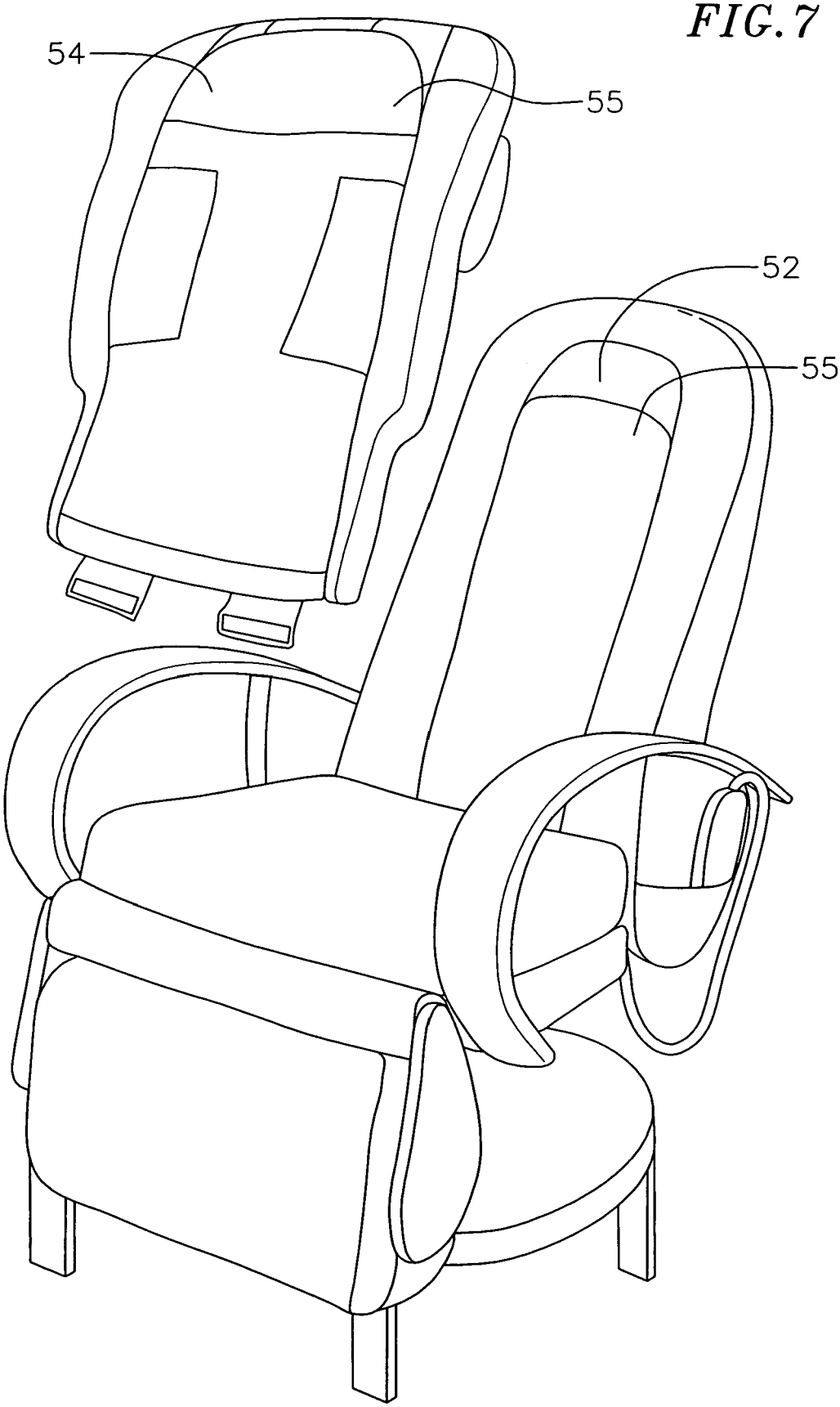
FIG. 7 is a perspective view of the massage chair of FIG. 6 with the removable back rest off.

Referring to FIGS. 6 and 7, in some massage chairs 50, the massage mechanism (not shown) is affixed in a frame having a nylon covering 52. A fabric upholstery overlay 54 is attached by velcro 55 or other conventional means to the top of the chair 56 and hangs over the nylon covering to form the back rest. In some existing chairs, the user may unzip the overlay and replace a piece of removable foam (not shown) with another piece having a different thickness. In this manner, the user may vary the massage intensity by physically replacing the foam in the backrest. This approach has the disadvantages of forcing the user to store individual pieces of foam and to exit the chair to replace the foam, thereby interrupting the massage.

Figure 8:
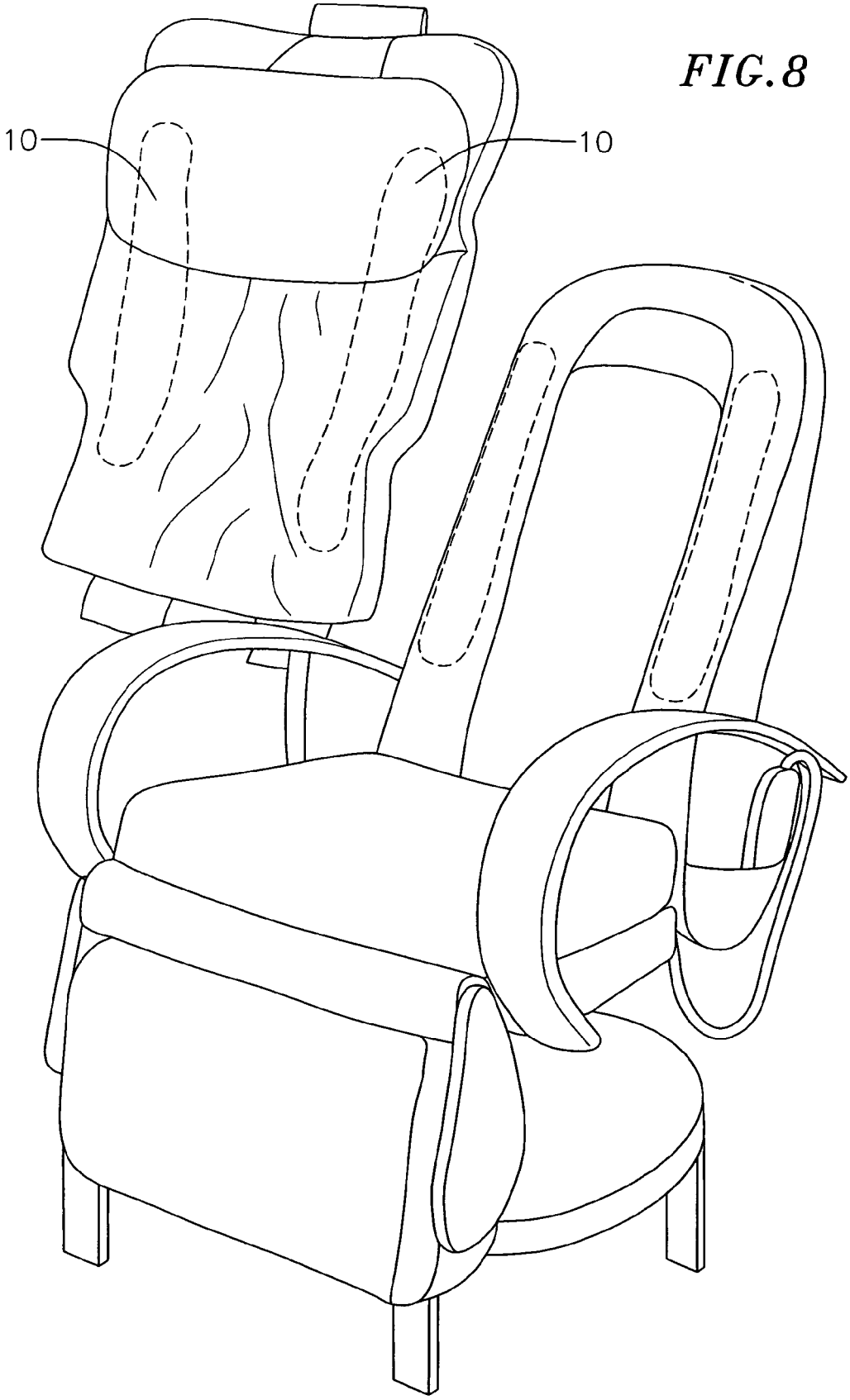
FIG. 8 is a view of an alternate embodiment of the present invention in which one or more controllable foam-filled bladders are contained within a removable back rest of a massage chair.

Referring to FIG. 8, in another alternate embodiment of the present invention, one or more foam-filled bladders 10 are placed within the fabric overlay 54 for a conventional massage chair 50. With control of the amount of air in the bladders, the user may desirably control the intensity of the massage without having to get up from the chair to remove and replace individual pieces of foam of varying thickness.

Figure 9:
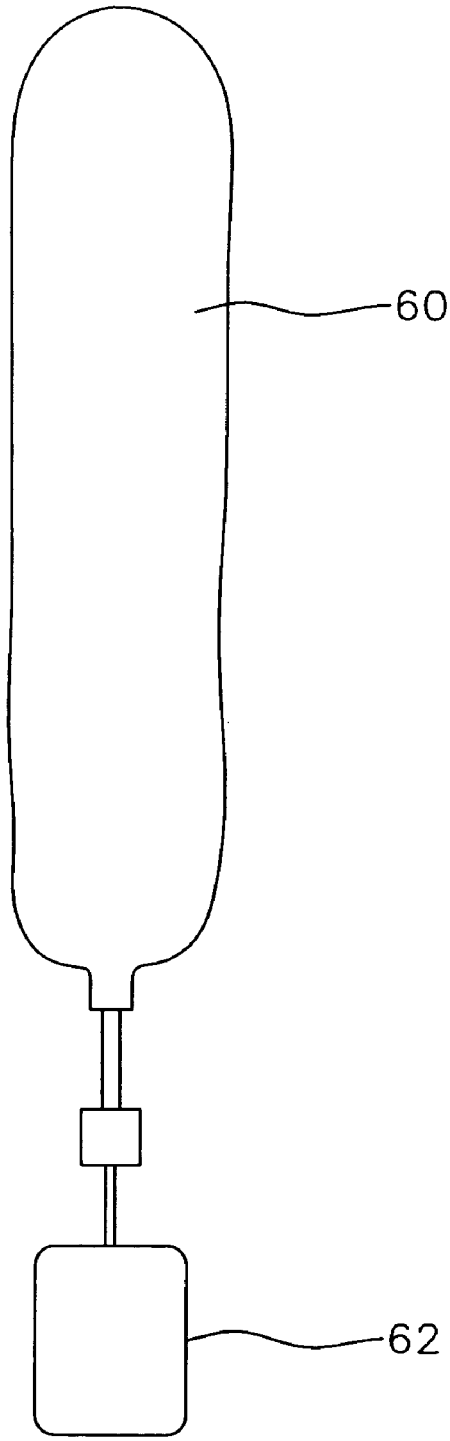
FIG. 9 is a view of still another alternate embodiment of the invention, in which an active pumping device is used to inflate one or more bladders.

Referring to FIG. 9, in still another alternate embodiment of the present invention, the bladders 60 may simply be inflated by pumping air into the bladders via a conventional active pump 62. In such an arrangement, the bladders may or may not include foam or other material to provide rigidity to the bladders in the deflated position.

It will be understood by those of ordinary skill in the art that various and numerous modifications may be made to the described embodiments without departing from the scope of the invention. The foam-filled bladders may be made in various shapes and sizes, and may be placed in various locations in a wide variety of massage devices, such as chairs, tables, mats and other devices to easily and effectively control the intensity of the massage felt by the user. As used herein, the term air may include air or any other gas.

What is claimed is:

1. Apparatus for controlling massage intensity in a massage device, the apparatus comprising:

a massage mechanism housed in the massage device;

an airtight bladder distinct from the massage mechanism in the massage device, the airtight bladder defining a cavity;

a foam core having a default thickness located within the cavity;

an air inlet to the bladder; and a vacuum pump operatively coupled to the inlet for decreasing an amount of air in the cavity to increase such massage intensity, wherein the massage mechanism is distinct from the pump; and wherein the bladder compresses the foam from its default thickness when air is removed from the cavity.

2. The apparatus of claim 1, wherein the pump includes a vacuum reservoir and evacuates air from the cavity to compress the bladder.

3. The apparatus of claim 1, wherein the default position of the bladder is in an expanded state.

4. The apparatus of claim 1, wherein the default position of the bladder is in a deflated state, and the bladder is inflated by adding air to the cavity.

5. The apparatus of claim 1, wherein the bladder includes neoprene.

6. The apparatus of claim 1, wherein the foam core includes polyurethane.

7. The apparatus of claim 1, further comprising a controllable valve for controlling air into and out of the cavity.

8. The apparatus of claim 7, further comprising a controller for automatically adjusting air into and out of the cavity as part of a massage program.

9. The apparatus of claim 1, wherein the amount of air within the cavity determines the massage intensity.

10. The apparatus of claim 9, wherein the bladder comprises a plurality of massage bladders, and the air in the cavity of each bladder is independently controllable.

11. The apparatus of claim 1, wherein the massage device comprises a massage chair.

12. A massage device for a massage chair comprising:

a massage mechanism;

one or more bladders disposed proximate to and distinct from the massage mechanism, wherein the bladder comprises a cavity;

one or more controllable valves for controlling an amount of air within the cavity; and a vacuum pump coupled to the bladder for decreasing the amount of air in the cavity to increase a massage intensity;

wherein the massage mechanism is distinct from the pump; and wherein the air within the cavity may be varied to alter the volume of the bladder, thereby affecting the intensity of massage felt by a user sitting in the massage chair.

13. The massage device of claim 12, wherein the bladder is made of neoprene.

14. The massage device of claim 12, wherein one or more of the bladders include foam housed within the cavity of the bladder.

15. The massage device of claim 14, wherein the foam is made of polyurethane.

16. The massage device of claim 14, further comprising:

an air inlet to the bladder;

wherein the foam core has a default thickness and the bladder compresses the foam from its default thickness when air is removed from the cavity.

17. The massage device of claim 16, wherein the massage device is a chair.

18. The massage device of claim 16, wherein the pump includes a vacuum reservoir.

19. A massage device comprising:

a massage mechanism;

one or more bladders disposed proximate to and distinct from the massage mechanism, wherein the bladder comprises a cavity;

one or more controllable valves for controlling an amount of air within the cavity;

wherein the air within the cavity may be varied to alter the volume of the bladder, thereby affecting an intensity of massage felt by a user sitting in the massage chair; and further comprising a frame for housing the massage mechanism, and an overlay containing the bladders for adjusting the massage intensity, the overlay removably attachable to the frame.

20. The apparatus of claim 11, wherein the massage mechanism and airtight bladder are housed within a backrest of the chair.

21. The Apparatus of claim 1, wherein the massage mechanism is proximate to the airtight bladder.

22. The apparatus of claim 1, wherein the pump is housed in the massage device.

23. The apparatus of claim 1, wherein the massage mechanism is mounted in a backrest of a massage chair.

24. The apparatus of claim 23, further comprising a controller having an automatic massage sequence.

25. The apparatus of claim 1, wherein the inlet is coupled to the pump by a tube.

26. The apparatus of claim 1, wherein the bladder is hermetically sealed and is airtight other than at the air inlet.

27. The apparatus of claim 1, further comprising a valve coupled to the air inlet to vary the amount of air in the cavity during a massage.

28. The apparatus of claim 1, wherein the bladder is removable from the massage mechanism.

29. The apparatus of claim 26, wherein the hermetic seal prevents fluid communication between the bladder and the massage mechanism.

30. A massage chair for providing a massage to a user, comprising:

a backrest portion;

a massage mechanism mounted in the backrest portion;

one or more inflatable bladders distinct from the massage mechanism, the bladder being hermetically sealed and airtight other than at an air inlet;

means for inflating the bladder to decrease an intensity of such massage; and means for deflating the bladder to increase the intensity of such massage.

31. The massage chair of claim 30, wherein the means for deflating comprises a vacuum pump distinct from the massage mechanism, the pump being coupled to a valve and the valve being coupled to the air inlet.

32. The massage chair of claim 31, wherein the bladder comprises a foam insert having a default thickness, wherein the bladder compresses the foam from its default thickness when the bladder is deflated.

33. The massage chair of claim 30, wherein the means for inflating comprises a pump distinct from the massage mechanism, the pump being coupled to a valve and the valve being coupled to the air inlet.

* * * * *